United States Patent [19]

Sword

[11] 4,384,945

[45] May 24, 1983

[54] PRODUCTION OF ROTARY SCREEN PRINTING CYLINDERS AND OTHER FINE-APERTURED SHEET MATERIALS

[76] Inventor: Wallace W. Sword, 27 Dorrington Rd., Sale, Cheshire, England

[21] Appl. No.: 192,512

[22] PCT Filed: Sep. 21, 1979

[86] PCT No.: PCT/GB79/00155

§ 371 Date: May 26, 1980

§ 102(e) Date: May 15, 1980

[87] PCT Pub. No.: WO80/00677

PCT Pub. Date: Apr. 17, 1980

[30] Foreign Application Priority Data

Sep. 26, 1978 [GB] United Kingdom ..... 38225/78
Aug. 8, 1979 [GB] United Kingdom ..... 7927603

[51] Int. Cl.[3] ..... C25D 13/06; C25D 13/14
[52] U.S. Cl. ..... 204/181 R; 204/181 C
[58] Field of Search ..... 204/181 R, 181 C, 181 F, 204/25, 17

[56] References Cited

U.S. PATENT DOCUMENTS

| | | | |
|---|---|---|---|
| 3,591,466 | 7/1971 | Heiman | 204/181 C |
| 4,210,507 | 7/1980 | Davidson et al. | 204/181 C |

FOREIGN PATENT DOCUMENTS

| | | | |
|---|---|---|---|
| 825419 | 12/1951 | Fed. Rep. of Germany | 204/8 |
| 941885 | 4/1956 | Fed. Rep. of Germany | 204/181 C |
| 1141295 | 12/1962 | Fed. Rep. of Germany | 204/181 R |
| 1181237 | 11/1964 | Fed. Rep. of Germany . | |
| 1905270 | 8/1970 | Fed. Rep. of Germany | 204/181 R |
| 1582692 | 10/1969 | France | 204/181 R |
| 2142596 | 2/1973 | France . | |
| 2225542 | 11/1974 | France | 204/49 |
| 301300 | 5/1929 | United Kingdom | 204/182 |
| 756315 | 9/1956 | United Kingdom | 204/25 |
| 1146613 | 3/1969 | United Kingdom | 204/181 R |

*Primary Examiner*—Howard S. Williams
*Attorney, Agent, or Firm*—Schwartz, Jeffery, Schwaab, Mack, Blumenthal & Koch

[57] ABSTRACT

A method of producing a rotary screen printing cylinder or other fine-apertured sheet material which comprises electro-deposition of a plastic material onto an electrically conductive fine-apertured cylinder or other sheet substrate. When applied to wire mesh cylinders, the method is a fast and effective way of reducing the aperture size. The method can also be operated so that plastic is deposited on one side only of the substrate to increase the substrate strength with little or no aperture size reduction.

14 Claims, 2 Drawing Figures

Figure 1:
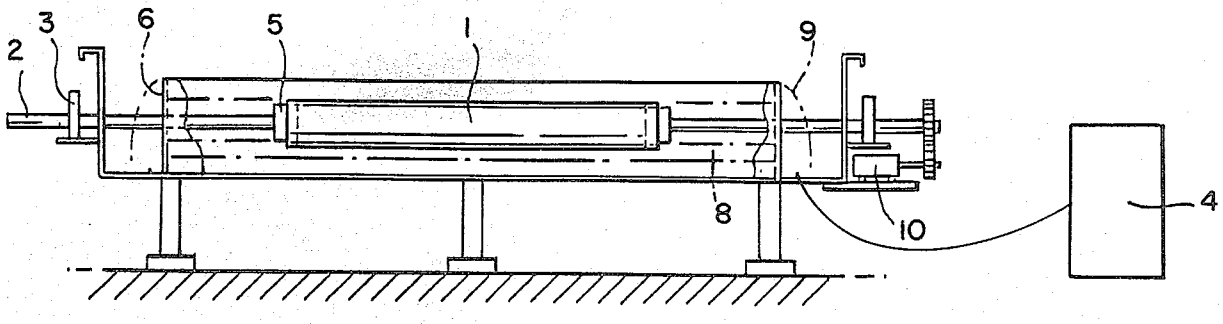

PRODUCTION OF ROTARY SCREEN PRINTING CYLINDERS AND OTHER FINE-APERTURED SHEET MATERIALS

This invention is concerned with a method of producing fine-apertured sheet materials and sheets produced by the method. It is in particular concerned with the production of rotary screen printing cylinders and will be described principally by reference to such cylinders. It is however to be understood that the invention has a wider applicability, for example in the production of flat fine-apertured sheets for other purposes, e.g. filtration or sieving.

In rotary screen printing, a cylinder of a fine-apertured sheet material is first engraved with the desired pattern to be printed by forming on the screen areas of blocked apertures forming a negative image of the pattern. There are thus areas on the screen whose apertures are unblocked and the print medium can be forced through these apertures to apply a positive image of the pattern onto the fabric.

The development of wire cloth rotary screen printing cylinders is described for example in British Patent Specification Nos. 756,315, 830,506, 1,050,649 and 1,208,109. The problems and advantages associated with these screens can be summarized as follows.

Woven wire mesh cloths which are sufficiently fine to give reasonably good definition in engraving and printing on textile fabrics (for example 60, 80 or 100 mesh per inch, usually woven from phosphor bronze wire or occasionally from Monel or stainless steel wire) invariably have too wide apertures and deposit too much print paste on the fabric for the printing conditions under which they have to work. In their normal loom state they also have low dimensional stability which can cause distortion and damage in printing as well as bad pattern registration in multi-colour printing; this is due to the different weights of print paste that each screen may contain at any given moment. In certain cases the apertures can be reduced to a suitable size by electrodeposition of copper and/or nickel, but as the amount of copper or nickel is increased the wire mesh becomes increasingly brittle and very easily damaged in printing or handling. Additionally, towards the end of the electroplating process, and as the apertures become smaller, it becomes more difficult to control accurately the termination of the process and to achieve high standards consistently.

A major advance in overcoming these difficulties was brought about by the introduction of a two-ply wire mesh/fabric screen as described in British Patent Specification No. 1050649. In this method, greatly improved strength and dimensional stability is obtained by first making a very strong cylinder from heavy gauge phosphor bronze wire and then giving this cylinder a lightly electroplated coat of nickel. This makes the cylinder chemically resistant to print-paste constituents and gives it extra dimensional stability. By covering this cylinder with either flat or tubular screen fabrics, (e.g. of polyester or polyamide) possessing small aperture sizes (e.g. between 50 and 150 microns), strong printing screens can be obtained with good dimensional stability. These screens are suitable for engraving and printing on textile fabrics to give well defined patterns. This type of screen has been used, with advantages in many cases over electroformed nickel perforated screens, since 1965.

Some disadvantages of two-ply wire mesh/fabric screens include: the high cost of fitting flat or tubular fabric onto a wire mesh cylinder; the possibility of the tubular fabric not being stuck firmly to the wire mesh cylinder; the possibility of damage to the tubular screen fabric, and the engraved detail, where it is worn by the fabric selvedge, or damaged by adhesive tape, which may be used to temporarily "mask out" and narrow the pattern width; and the necessity of using either special engraving techniques, or when using conventional photo-sensitive resin emulsions for engraving, of being unable to bake at high temperature to obtain maximum durability, on account of the poor heat stability and heat resisting qualities of the fabric material.

A similar method, in which a relatively coarse screen cylinder is covered with a tubular fine-mesh fabric, is also described in Swiss Patent Specification Nos. 545692 and 7205/72.

In another method which is widely used, the screen cylinder is formed by electrodeposition of metal on a mandrel. The so-called electroforms produced by this method can have very small aperture sizes and a high aperture density (e.g. up to about 2000 per $cm^2$); however, the mandrels required are expensive and the electroforms are brittle and require very careful handling.

I have now found a new method of producing fine-apertured sheet materials, e.g. having aperture sizes ranging from 50 to 500 $\mu m$ and particularly those for use in rotary screen-printing, which involves forming a coating of plastic material on a fine-apertured sheet substrate by electrodeposition of the plastic material.

This method has many advantages. The plastic coating has the advantage of increasing the strength of the substrate and reducing its brittleness. The method can be operated with or without reduction in the aperture size, and if desired some of the apertures can be closed completely. The plastic can be coated onto the substrate quickly, evenly and accurately, and the deposition can be accurately terminated. The deposition is thus easily controllable and allows consistent standards to be achieved at low cost. The method is primarily applicable to the treatment of fine-apertured sheet for rotary screen printing cylinders, and is a fast and inexpensive way of making such cylinders.

As indicated above, in a principle embodiment of the invention, the method is operated to reduce the aperture size. This is particularly useful when the substrate apertures are relatively coarse (e.g. 100–500 $\mu m$), as for example in wire mesh rotary printing screens. A sheet can be made with a very small aperture size and a good aperture density that is sufficiently strong for continuous use without being brittle. For example, if a nickel-plated phosphor bronze wire mesh cylinder (of the type normally intended to be covered with a tubular screen fabric) is coated by my method, the aperture size can be reduced in 1 to 3 minutes to such a degree that the fine-mesh fabric cover is unnecessary. Not only does the coating operation take less time to perform than it takes to fit a screen cover over a cylinder, but the expensive covers can be dispensed with altogether. Moreover, a range of printing screen cylinders having different aperture sizes can easily be produced for use with different print pastes and fabrics from one quality of wire mesh, thus eliminating the time and expense of fitting a selected quality of fabric cover over the same cylinder according to the particular paste being used and fabric being printed.

Printing cylinders produced by this method are of particular advantage, on account of their strength, for use on wide textile printing machines and carpet printing machines, in place of the electroformed nickel screens normally used.

In comparison with the alternative technique of reducing the aperture size by electrodeposition of metal, this method is again much quicker and cheaper. Plastics are less expensive materials than nickel or copper, and the deposition time of 1 to 3 minutes compares very favourably with times of 0.5 to 3 hours required for electroplating. The method is also more accurate and, unlike electroplating, does not give a brittle product.

The fine-apertured substrate which can be coated by this method may be any suitable electrically conductive material. It may for example be either metallic or non-metallic, and it may be woven or non-woven. The substrate is preferably made of metal, such as phosphor bronze, which may be lightly electroplated with for example nickel or copper, or it may be made of stainless or non-stainless steel, copper, aluminium, nickel, brass or Monel. These metallic substrate sheets are preferably used in the form of a wire mesh.

Alternatively, a fine-apertured non-metallic substrate may be used, for example of a plastics material. Substrates of this kind are not naturally electrically conductive and they therefore have to be coated or otherwise treated with an electrically conductive material to enable them to be used in the electrodeposition coating step. Plastics may for example be rendered conductive by coating with graphite or an electrolyte, as is well known in the electroplating and electrodeposition arts. Electroplated plastic (e.g. nickel-plated polyester) may also be used, as described in British Patent Specification No. 1,332,046. Suitable plastics for the substrate are synthetic or natural polymeric materials, e.g. polyesters, polyamides, polyolefins such as polypropylene, or regenerated cellulosic materials. These materials are again preferably used in mesh form.

The aperture size of the sheet substrate may for example be from 100 to 500 microns, usually 150 to 300 microns, and the size may be reduced by the electrophoretic coating to, for example, 40 to 200 microns. However, sheets having smaller aperture sizes (e.g. down to 35 μm) can also be used.

My electrodeposition method can also be used to increase the strength of the substrate material with litle or no reduction in aperture size. This is of particular value in connection with electroforms for rotary screen printing, which have a satisfactory combination of aperture size and aperture density in their original state but lack strength and structural stability.

In this embodiment of the method, the plastic material is electrodeposited onto one side only of the electrically conductive fine-apertured sheet substrate.

The substrate sheet may again be in the form of a cylinder, e.g. a rotary screen printing cylinder, and is preferably an electroformed rotary printing cylinder. If desired however the substrate may be a flat sheet, which can either be formed into a cylinder after being coated by the method of the invention or be left flat for other uses, e.g. as a filter or sieve.

A number of different techniques can be adopted to ensure that only one side of the substrate is coated.

For example, one side of the substrate (the side which is not to be coated by electrodeposition) may be temporarily protected by a coating or film of a non-conductive material. The non-conductive coating can then be removed after electrodeposition of the plastic material. The non-conductive coating material should be water-insoluble and easily removable after electrodeposition, for example with an organic solvent; examples of suitable materials are esters of poly (methylvinyl ether/-maleic acid) such as the monobutyl ester sold under the trade name Gantrez ES 435 (GAF), bitumen or ultraviolet hardened polyvinyl alcohol. Gantrez ES 435 can for example be removed with an organic solvent such as isopropanol. Hardened polyvinyl alcohol is removable with sodium hypochlorite solution. Another material which may be used is "Pro-peel" (a polyvinyl chloride solution made by TAK Chemicals Ltd.) which can be peeled off after the electrodeposition process.

When a cylindrical substrate is used, the inside of the cylinder can be protected during electrodeposition by inflating a bag or tube (e.g. of rubber) inside the cylinder. The bag or tube can be simply deflated and removed after electrodeposition, leaving the inner surface of the cylinder uncoated.

Another alternative technique can be used when applying my method to an electroform. Electroforms are produced by electrodeposition of metal (usually nickel) on a mandrel, and the plastic material can simply be electrodeposited into the outer surface of the electroform whilst it is on the mandrel. Thus, after deposition of the metal onto the mandrel and washing with water, the mandrel can be transferred to the tank for electrodeposition of the plastic material; the electroform remains on the mandrel and the mandrel prevents coating of the inner surface of the electroform. A particular advantage of this method is that reduction of the aperture size is prevented by the resist already on the mandrel, the electrodeposited plastic material acting only to strengthen the cylinder.

Electroform printing cylinders are of very light construction and normally have for example a metal thickness of 60–200 μm, aperture diameters of 50–400 μm and from 250–1800 apertures per $cm^2$. The thinner cylinders generally have the larger aperture densities and smaller aperture sizes, and they are easily damaged in handling both on and off the printing machine. Extra strength and durability can be obtained by increasing the metal thickness, but the apertures then become coarser and much design detail is lost in engraving and printing. For example, a cylinder 80 μm thick may have about 1800 apertures/$cm^2$ and aperture diameters of about 60 μm; this is a good combination of aperture sizes and diameters for detailed printing, but the screens are very delicate. On the other hand, screens 90 to 110 μm thick (having aperture diameters of 120 or 150 μm and aperture densities of about 1000 or 600) are noticeably stronger, but are less suitable for detailed work.

The coating of one side of the sheet enables the strength of the thin electroform cylinders to be increased without reducing the aperture size or density. The electrodeposition method can for example be used to deposit a coat of plastic 5–40 μm thick on the electroform, and this considerably increases the strength and resistance to tearing and creasing.

One-side coating can also be applied to coarser electroforms (e.g. those 90–200 μm thick), and here some reduction in aperture size can be allowed to occur and in some circumstances is positively desirable. This is achieved by applying an extra thick coating of plastic. This not only reduces the amount of colour which can pass through the screen but gives a smoother-edged aperture as compared to the irregular edged apertures frequently present on such screens. This allows for better registration of multicoloured designs, as the screens are again stronger, less flexible and less brittle than uncoated cylinders. The reduction in aperture diameter can for example be from 10–20 or 30 μm, depending on circumstances.

The one-side coating method can also be applied to the relatively coarse substrates described above, of both the metallic and non-metallic kind. It can for example be applied to wire meshes for rotary printing cylinders, which generally have aperture diameters of 150–300 μm. Some aperture size reduction normally occurs during electrodeposition with such substrates, but as indicated above this is desirable.

The coating of the sheet substrate in my method may be performed by known electrodeposition techniques. Such methods are for example described in British Patent Specification Nos. 482,548, 972,169, 933,175, 970,506, 998,937, 1,003,238, 1,419,607 & 1,382,512, U.S. Pat. No. 3,200,057, and Dutch Patent Specification Nos. 6407426, 6407427, 6407428 and 6407429.

Thus in general the clean substrate may be connected to an electrical supply and immersed in a tank containing an aqueous dispersion, emulsion or solution of the plastic material which is to form the coating. The substrate will usually be connected as the anode, but it can also be used as a cathode with cathodically-depositable plastics. When current is passed through the bath, a coating of the plastic is rapidly and evenly built up on the substrate. Currents of for example 2–20 amps/ft$^2$ (2–20 mA/cm$^2$) at 30 to 150 volts may be used at temperatures of 20° to 45° C., using coating times of 0.25–3 minutes. The coating operation can be accurately terminated by appropriate choice of coating time, voltage and current. In some cases, the process can be self-terminating as the coating itself is non-conductive.

A cylindrical substrate is preferably rotated during the coating operation to ensure uniform coating and the current may be reversed when coating is complete to allow the sheet to be lifted out cleanly from the tank. The fluid in the tank is preferably continuously agitated, and may be continuously circulated and filtered to remove undesirably large particles. The coating tank is also preferably thermostatically controlled. On completion of the coating process, the substrate may be rinsed and air-dried to remove excess water.

When the coated sheet is to be used in rotary screen printing, the substrate sheet is preferably first formed into a cylinder and then coated. The method can however be also applied to flat substrate sheets on either a continuous or discontinuous basis; the coated sheet can then be formed into cylinders or left flat for other uses, e.g. as filters or sieves.

The plastics material used for the coating may in general be any type of synthetic or natural polymeric material which can be used in electrodeposition methods, for example epoxy, acrylic, polyester, polyurethane or alkyd resins, and cross-linkable vinyl polymers and non-hardenable resins and polymers. A thermosetting plastic is preferably used, particularly if the coated sheet is subsequently to be subjected to baking (e.g. at 120° to 200° C.) during an engraving process. Non-hardenable thermoplastics may however also be used. The choice of resin may be varied according to particular circumstances; for example, modified alkyd resins give more flexible films, whereas butadiene and acrylic resins give harder films which are more resistant to abrasion. The electrodeposition bath may also contain additives (such as pigments, dyes or extenders), as in conventional practice.

One advantage of the electrodeposition method is that the coating can easily be removed if desired, before baking. Stripping can be effected with ammonia solution, amines such as diethylamine, polyvinylpyrrolidone, paint stripping solutions or caustic soda. This can be useful if for some reason the coating is imperfect.

After electrodeposition, the sheet may be engraved for use in screen printing by conventional screen engraving techniques to give the desired pattern of permeable and impermeable areas. This can for example be done using photographic techniques by means of the photosensitive resin emulsions normally available for screen engraving, using in this case a positive film for the light exposure process.

Alternatively, the cylindrical screen can be engraved before electrodeposition so that only the open permeable parts of the screen have the apertures reduced in size whilst the apertures in the non-permeable parts are completely blocked by light hardened resin emulsion.

To obtain the reverse effect when engraving before electrodeposition, the wire mesh cylinder can be engraved photographically with a negative film of the design by coating the cylinder with light-sensitised polyvinyl alcohol so that the image formed acts as a resist during electrodeposition which is conducted to give complete closure of apertures. The light-hardened polyvinyl alcohol is then removed by stripping agents such as sodium hypochlorite to leave the permeable parts of the screen with completely open apertures.

The electrodeposition is described in further detail below, with reference to the drawings.

Figure 2:
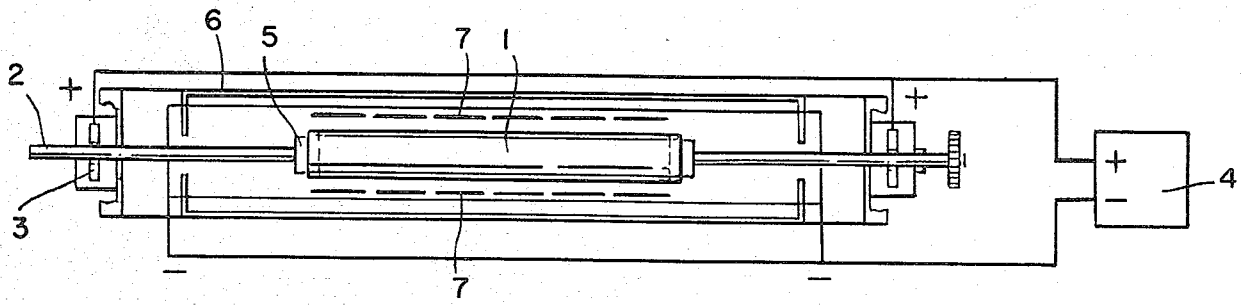

FIG. 1 of the drawings shows in elevation an electrodeposition tank suitable for coating rotary printing cylinders and FIG. 2 is a plan of the same tank.

A cylindrical wire cloth screen (1) is placed on a mild steel shaft (2) each end of which rests on two brass V-block contactors (3) which are connected to the positive terminal of a DC power source (4). The cylindrical screen (1) is fixed at each end to mild steel rings (5) by means of either steel screws, or by a Jubilee Clip firmly clamping the ends of the screen to the rings. The two rings (5) are in turn firmly bolted to the steel shaft (2) thereby completing contact to the positive terminal of the power source (4) so that the cylinder for the purpose of the coating process is the anode.

The cathode can be either the sides of the mild steel coating tank (6) providing that it has not been lined with an insulating material, or preferably, the mild steel plates (7) corresponding to the length and diameter of the wirecloth cylinder. The mild steel plates are supported opposite each side of the cylinder, e.g. about 3 cms or more away, as may be desired.

The coating solution (8) is pumped into the inner section of coating tank (6) and the level maintained by pumping the solution continuously over the weirs (9) from an adjacent overflow tank (not shown). A thermostatically controlled heater is fitted to maintain the desired solution temperature, normally for convenience 20° C., and a filter unit is placed between the coating tank and the pump to ensure solution clean lines.

Before commencing the coating process the cylindrical screen (1) is rotated on the steel shaft (2) by means of spur gears fitted to the steel shaft and the driving motor (10).

A direct current is then passed between the cylindrical anode and the cathode steel plates. Under the influence of the electric field, negatively charged particles come into contact with the positively charged cylinder. The particles then lose their charge and deposit as a coating on the cylinder.

After completion of the required coating time, the cylinder is removed from the coating tank and any undeposited coating solution is washed from the cylinder by a spray of cold water.

The process is completed by drying, e.g. by first drying at low temperature and then at 120°–200° C. The following Examples illustrate the invention. In each case the apparatus shown in the drawings was used.

EXAMPLE 1

Substrate: Phosphor bronze plain weave wirecloth cylinder (lightly nickel plated) with 60 apertures per 25.4 mm, aperture size of 250 microns and wire diameter of 170 microns.
Coating solution: A melamine-modified alkyd resin (Code X6126; Macpherson Industrial Coatings Limited, Lancashire, England) which is a water soluble polymer neutralised with an organic base containing small amounts of coupling solvent (specifically butyl alcohol) or alternatively butyl glycols, plus a small amount of phthalocyanine blue pigment dispersion in low concentration added as a sighting agent.
Solids content: 5%
Conductivity: between 500 and 5000 Microsiemens but specifically 2500 microsiemens.
pH: 7.9
Temperature: between 15°–30° C. (but specifically 20° C.)
Voltage: 30–150 volts (but specifically 50 volts).
Current Density: 10 amps/square foot (10 mA/cm$^2$)
Coating Time: $1\frac{3}{4}$ minutes After coating the 250 micron square apertures had changed to 210 micron circular apertures.

EXAMPLE 2

Substrate: Phosphor bronze plain weave wirecloth cylinder (lightly nickel plated) with 80 apertures per 25.4 mm, aperture size of 186 Microns and wire diameter of 132 microns.
Coating Solution: Resin Code X6126
Solids content: 5%
pH: 7.9
Conductivity: 2500 Microsiemens
Temperature: 20° C.
Current Density: 10 Amps/square foot (10 mA/cm$^2$)
Voltage: 50
Coating time: 1 Minute After coating the 186 micron square apertures had changed to 140 micron round apertures.

EXAMPLE 3

Substrate: Phorphor bronze twill weave wire cloth cylinder (lightly nickel plated) with 66 apertures per 25.4 mm, aperture size of 145 microns and wire diameter of 240 microns.
Coating solution: resin Code X6126
Solids content: 5%
pH: 7.9
Conductivity: 2500 microsiemens
Temperature: 20° C.
Current density: 9 amps/square foot (9 mA/cm$^2$)
Voltage: 50 volts
Coating time: $1\frac{1}{4}$ minutes After coating the 145 μm square apertures changed to 100 μm rounded apertures.

EXAMPLE 4

Substrate: Phosphor bronze twill weave wirecloth cylinder with 66×50 apertures per 25.4 mm, aperture size of 145×230 microns and wire diameters of 240 and 280 microns.
Coating solution: Resin Code X6126
Solids content: 5%
pH: 7.9
Conductivity: 2500 Microsiemens
Temperature: 20° C.
Current density: 10 amps/square foot (10 mA/cm$^2$)
Voltage: 50
Coating time: 3 minutes After coating the rectangular apertures had changed to elliptical apertures size 110×190 microns.

EXAMPLE 5

Substrate: Phosphor bronze twill weave wirecloth sheet (lightly nickel plated) with 66 apertures per 25.4 mm, aperture size of 145 microns and wire diameter of 240 microns.
Coating solution: A butadiene base resin (Macphersons Industrial Coatings Limited) Code 11180 neutralized with an organic base and containing small amounts of coupling solvents plus phthalocyanine blue pigment dispersion in low concentration as a sighting agent.
Solids content: 5.4%
pH: 8.8
Conductivity: 2050 microsiemens
Temperature: 20°
Current density: 10 amps/ft$^2$. (10 mA/cm$^2$)
Voltage: 60
Coating time: 2 minutes After coating the aperture size had been reduced from 145 microns to 110 microns.

EXAMPLE 6

Substrate: Electroformed fine apertured sheet with 60 apertures per 25.4 mm, aperture size of 140 microns, half of one side being coated with the product Pro-peel (TAK Chemical Industries Limited, England) to act as a resist to the coating process.
Coating solution: resin code X 6126
Solids content: 5%
pH: 9
Conductivity: 2500 Microsiemens
Temperature: 20° C.
Voltage: 30
Coating Time: 3 Minutes
Current density: 6.5 amps/square foot (6.5 mA/cm$^2$)

After coating the area covered by Pro-peel remained clear and the opposite side of the electroformed sheet was coated with resin. The apertures in this part retained their original size. In the part not coated with Pro-peel the electroform was coated on both sides with resin and the apertures reduced in size to 120 microns.

I claim:

1. A method of coating a rotary screen printing cylinder with a plastic material, said cylinder being electrically conductive and having apertures in its surface of a size ranging from 35 to 500 μm, which method comprises engraving the cylinder photographically with a film of the design to be printed to produce engraved areas and non-engraved areas on the cylinder, electrodepositing the plastic material uniformally over at least one surface of the cylinder to strengthen the cylinder and to close the apertures completely in the non-engraved areas of the cylinder.

2. A method of coating a rotary screen printing cylinder with a plastic material, said cylinder being electrically conductive and having apertures in its surface of a size ranging from 35 to 500 μm, which method comprises the electrodeposition of the plastic material uniformally over at least one surface of the cylinder to strengthen the cylinder and to reduce the aperture size uniformally.

3. The method of claim 2 wherein the initial aperture sizes are from 100 to 500 μm in a wire mesh rotary screen printing cylinder and are reduced to 40 to 200 μm by the electrodeposition for plastic material.

4. A method of coating a rotary screen printing cylinder with a plastic material, said cylinder being electrically conductive and having apertures in its surface of a size ranging from 35 to 500 μm, which method comprises the electrodeposition of the plastic material uniformally over at least one surface of the cylinder to strengthen the cylinder without aperture size reduction.

5. The method of claim 1, 2 or 4 wherein the cylinder is a wire mesh rotary screen printing cylinder.

6. The method of claim 1, 2 or 4 wherein the plastic material is deposited on one surface of the cylinder.

7. The method of claim 6 wherein the cylinder is an electroformed rotary screen printing cylinder.

8. The method of claim 7 wherein said electroformed rotary screen printing cylinder is formed by electrodeposition of a metal on a mandrel and wherein the surface of the cylinder which is not to be coated is protected during the electrodeposition process by the mandrel itself.

9. The method of claim 6 wherein the surface of the cylinder which is not to be coated is protected during the electrodeposition process.

10. The method of claim 9 wherein the surface is protected by a coating or film of a non-conductive material.

11. The method of claim 9 wherein the surface is protected by inflating a bag or tube inside the cylinder.

12. The method of claim 1, 2 or 4 wherein the plastic material is deposited on two surfaces of the cylinder.

13. The method of claim 1, 2 or 4 wherein the plastic material is selected from the group consisting of epoxies, acrylics, polyesters, polyurethanes, alkyds and cross-linkable vinyl polymers.

14. The method of claim 1, 2 or 4 wherein the electrodeposition is effected by immersing the cylinder in a tank containing the plastic material in the form selected from the group consisting of aqueous dispersions, emulsions or solutions and then depositing said plastic using a current density of 2:20 $mA/cm^2$ at 50 to 150 volts at a temperature of 20° to 45° C. for 0.25 to 3 minutes, wherein said cylinder is connected as either the anode or the cathode.

* * * * *